US005847312A

United States Patent [19]

Walters et al.

[11] Patent Number: 5,847,312

[45] Date of Patent: Dec. 8, 1998

[54] SHAPED CHARGE DEVICES WITH MULTIPLE CONFINEMENTS

[75] Inventors: William Walters, Elkton; Steven Segletes, Bel Air, both of Md.

[73] Assignee: The United States of America as represented by the Secretary of the Army, Washington, D.C.

[21] Appl. No.: 879,861

[22] Filed: Jun. 20, 1997

[51] Int. Cl.[6] ..... F42B 1/02

[52] U.S. Cl. ..... 102/309; 102/307; 102/476

[58] Field of Search ..... 102/307, 309, 102/476

[56] References Cited

U.S. PATENT DOCUMENTS

| | | | |
|---|---|---|---|
| 3,885,929 | 5/1975 | Ridgeway | 102/307 X |
| 4,594,947 | 6/1986 | Aubrey et al. | 102/307 X |
| 4,655,139 | 4/1987 | Wilhelm | 102/309 X |
| 4,860,654 | 8/1989 | Chawla et al. | 102/306 |
| 4,862,804 | 9/1989 | Chawla et al. | 102/309 |
| 4,892,039 | 1/1990 | Emerson et al. | 102/476 |
| 4,896,609 | 1/1990 | Betts et al. | 102/309 |
| 4,942,819 | 7/1990 | Thoma et al. | 102/476 |
| 5,509,357 | 4/1996 | Lawther | 102/307 |
| 5,565,644 | 10/1996 | Chawla | 102/307 |

FOREIGN PATENT DOCUMENTS

| | | | |
|---|---|---|---|
| 2672380 | 8/1992 | France | 102/309 |
| 2246621 | 2/1992 | United Kingdom | 102/309 |

*Primary Examiner*—Peter A. Nelson
*Attorney, Agent, or Firm*—Paul S. Clohan, Jr.

[57] ABSTRACT

A shaped charge device having at least a double confinement configuration and utilizing a standard shaped charge liner inserted into a hollow cavity in the inner explosive fill. The inner explosive fill is surrounded by an inner confining case which may be made from any metal, ceramic, or composite. The uniqueness of the present invention is the addition of an outer layer of explosive containing an outer confinement case. Also utilized in the device are a booster, and a detonator, held by a centering device, to initiate the device according to standard practice. The device acts to use the outer explosive as a tamping material surrounding the inner confining case material. This will delay the expansion of the inner confinement case and increase the pressure on the liner. Increasing the pressure on the liner will increase the kinetic energy of the resulting penetrator jet.

6 Claims, 3 Drawing Sheets

SHAPED CHARGE DEVICES WITH MULTIPLE CONFINEMENTS

BACKGROUND OF THE INVENTION

Existing shaped charge designs in current use for weapon systems, oil well completion, or drilling operations are intended to provide a deep hole in the target material or to maximize the crater volume. These shaped charge configurations achieve maximum penetration by projecting a long rod or stream of particles, in near perfect alignment, against the target material. Since penetration is directly proportional to the length of the penetrator, care is taken to maximize the jet length. A confinement body is sometimes used to increase or maintain the pressure on the jet in order to increase the jet tip velocity, the jet tail velocity, and/or the jet stretch rate. However, the confining metal body may be massive, thus increasing the weight of the device. The confining body has an additional effect in providing a fragmenting case which can add to the lethality of the warhead by projecting fragments from the metal charge.

BRIEF SUMMARY OF THE INVENTION

It is therefore an object of the present invention to enhance the performance of a shaped charge liner by the use of two or more confinement bodies.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by a shaped charge device having a double confinement layer although more than two confinement layers may be employed. In this device, which is axisymmetric, a standard shaped charge liner is utilized. The liner is inserted into a hollow cavity in the first or inner explosive fill. A conical liner is typical but any arcuate shape may be used. The inner explosive fill is surrounded by a first or inner confining case which may be made from any metal, ceramic, or composite. Common materials are steel, glass reinforced plastics, aluminum, or tungsten. The uniqueness of the present invention is the addition of a second or outer layer of explosive, of the same or a different type than the inner explosive layer. In turn, the second explosive layer contains a second confinement case. The second confinement case need not be of the same material or geometry as the first confinement case. The types of explosive used in the two layers, the explosive masses, the confining case materials and masses can be easily determined by known calculation methods depending on the effects desired. Such calculations, called Gurney calculations are standard practice and many case/explosive (charge to mass ratios, Gurney energy) combinations are possible. Also utilized in the device are a booster, and a detonator, held by a centering device, to initiate the device according to standard practice. The device acts to use the outer explosive as a tamping material surrounding the inner confining case material. This will delay the expansion of the inner confinement case and increase the pressure on the liner. Increasing the pressure on the liner will increase the kinetic energy of the resulting penetrator jet.

DETAILED DESCRIPTION OF THE INVENTION

Prior art shaped charges with confinement bodies are relatively heavy since the confining case is usually fabricated from tungsten or steel. The present invention utilizes a confinement case of lower weight by using confining case/explosive combinations which have the same effect as, but weigh less than, a single element confining case. In addition, the use of two or more metal confinement casings provides a secondary fragmentation pattern which may increase the lethality of the device. The performance of the shaped charge liner is not in any way degraded.

Figure 1:
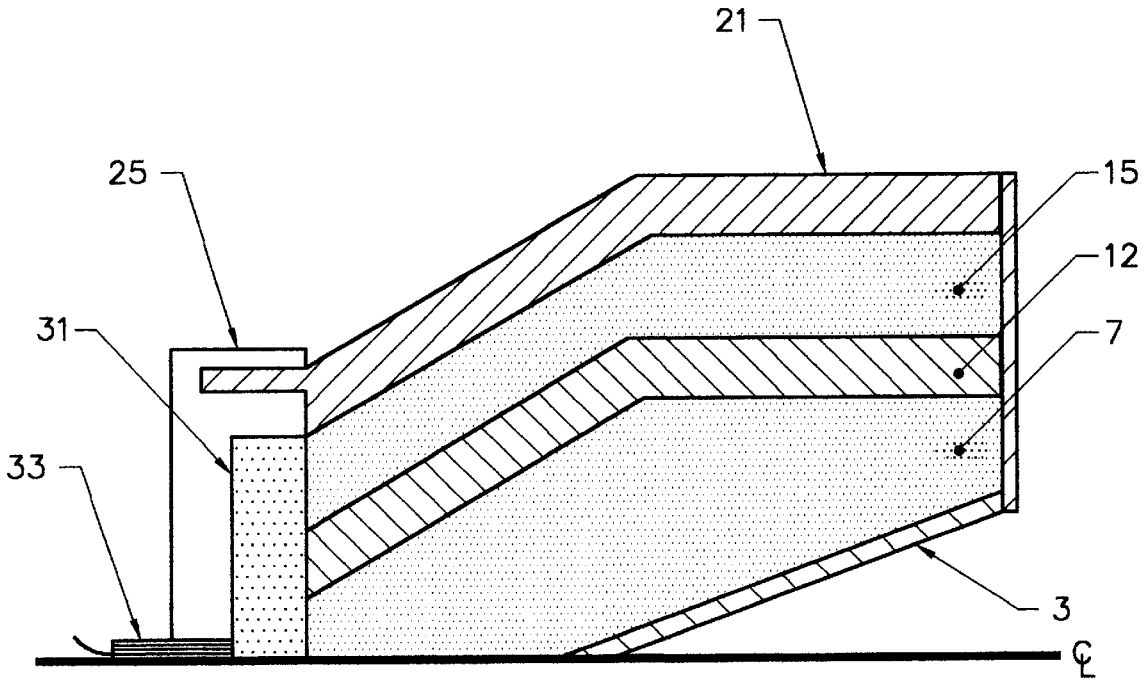
FIG. 1 is a cross sectional view of a shaped charge configuration according to the teachings of the present invention having a double confinement.

Referring now to FIG. 1, a cross sectional view of a shaped charge configuration according to the teachings of the present invention having a double confinement layer 12 and 21 is shown. It should be understood, however, that more than two confinement layers may be employed. In this embodiment, which is axisymmetric, as shown in FIG. 1, utilizes a shaped charge liner 3. Liner 3 is inserted into a hollow cavity in explosive fill 7. A conical liner 3 is shown in FIG. 1 but any arcuate shape may be used. Note that one-half of the axisymmetric device is shown in the figures and the developing jet will project towards the top of the page along the centerline. Explosive fill 7 is surrounded by a confining case 12 which may be made from any metal, ceramic, or composite. Common materials are steel, glass reinforced plastics, aluminum, or tungsten. The uniqueness of the present invention is the addition of a second layer of explosive 15, of the same or a different type that explosive layer 7. In turn, second explosive layer 15 contains a second confinement case 21. Confinement case 21 need not be of the same material or geometry as confinement case 12. The types of explosive used in the two layers, the explosive masses, the confining case materials and masses can be easily determined by known calculation methods depending on the effects desired. Such calculations, called Gurney calculations are standard practice and many case/explosive (charge to mass ratios, Gurney energy) combinations are possible. Also utilized in the embodiment shown in FIG. 1 are booster 31, and detonator 33, held by centering device 25, to initiate the device according to standard practice. The FIG. 1 device acts to use explosive 15 as a tamping material surrounding the inner case material 12. This will delay the expansion of confinement case 12 and increase the pressure on liner 3. Increasing the pressure on liner 3 will increase the kinetic energy of the resulting penetrator jet.

Figure 2:
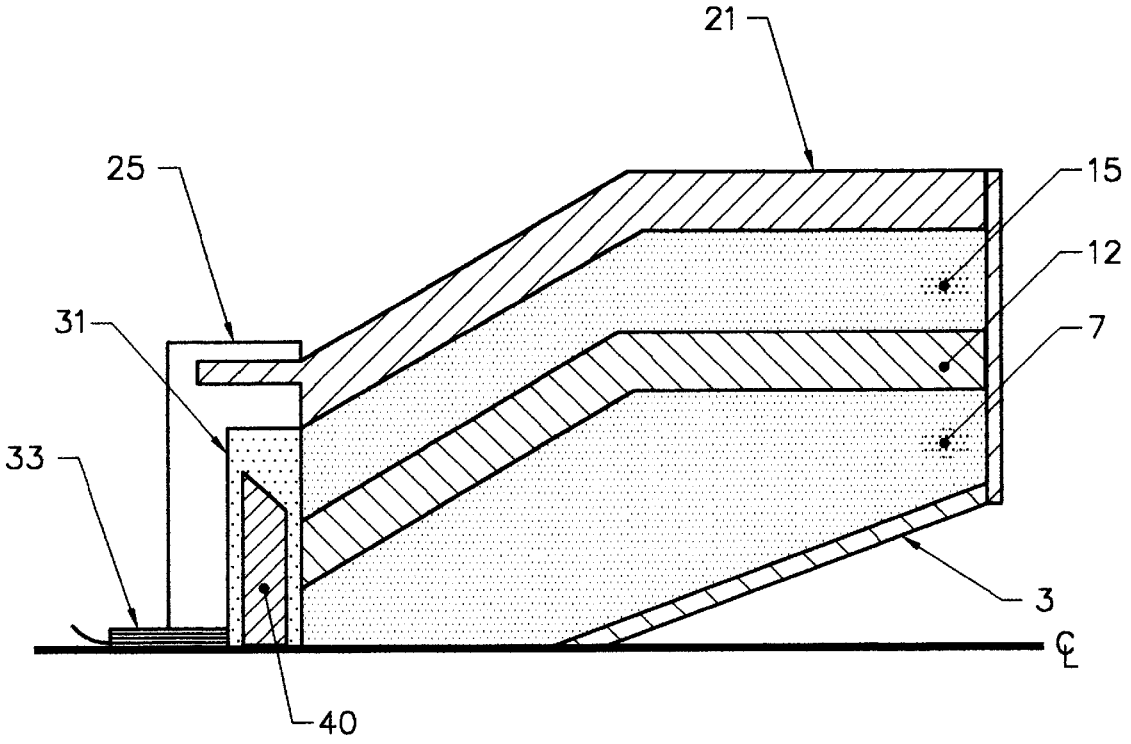
FIG. 2 is a cross sectional view of a shaped charge configuration according to the teachings of the present invention having a double confinement and a modified initiation train region.

FIG. 2 is a cross sectional view of a second shaped charge configuration according to the teachings of the present invention having a double confinement and a modified initiation train region. In this embodiment, the initiation train is modified to include a waveshaper 40 surrounded by booster material 31. The purpose of waveshaper 40 is to initiate explosive layer 15 prior to explosive layer 7. This will act to compress confinement case 12 prior to the detonation of explosive layer 7, again increasing pressure on liner 3. This delay between initiation of either explosive train, as well as the order in which they are initiated, will influence the shaped charge jet and fragmentation characteristics.

Figure 3:
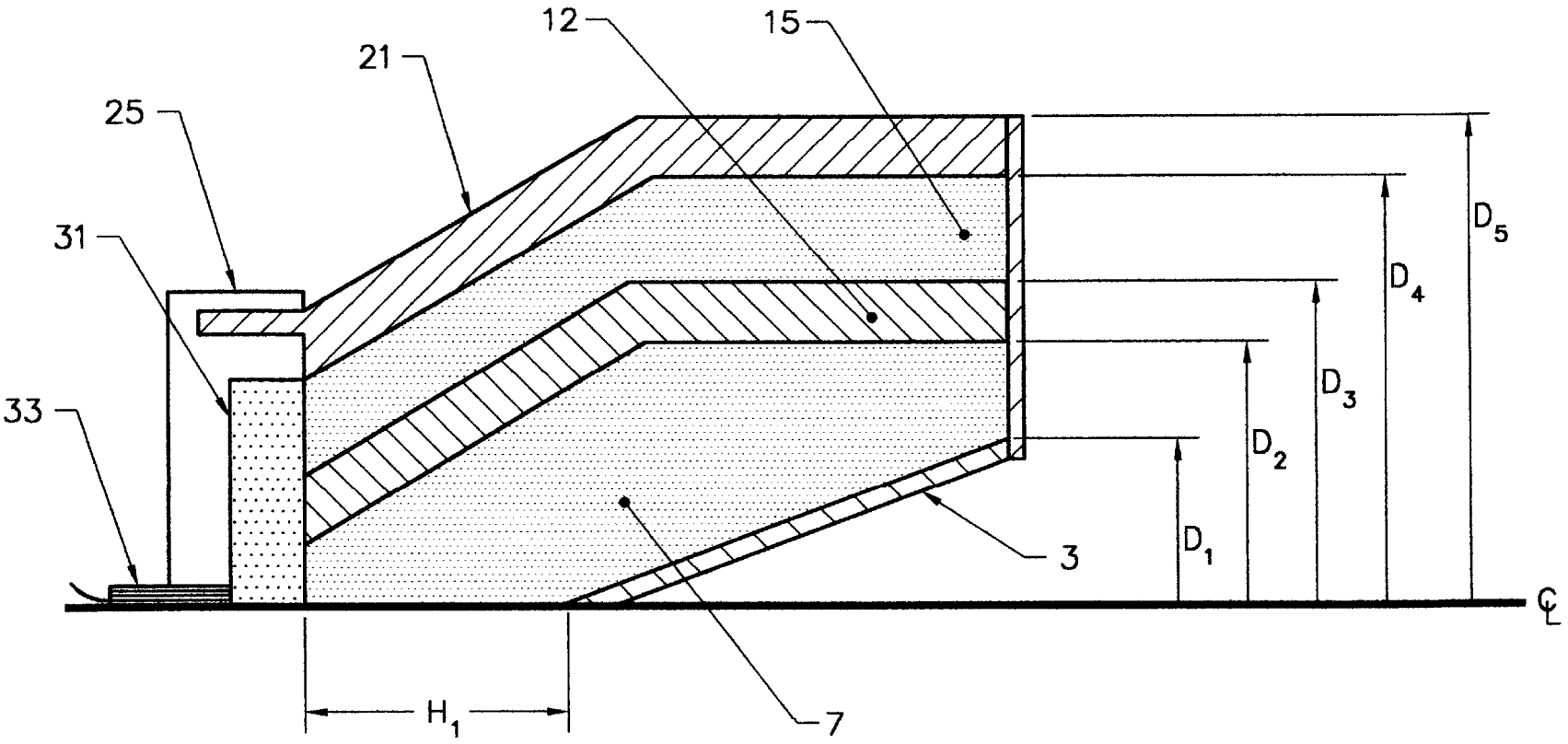
FIG. 3 is identical to FIG. 1 and having relevant charge dimensions shown.

FIG. 3 shows the relevant charge dimensions. In FIG. 3, $D_1$ is the outer diameter of liner 3 and typically ranges from 0.25" to 3'. $D_2$–$D_1$ ranges from 0 to 1.4 $D_1$. $D_3$–$D_2$ ranges from 0.01 $D_1$ to 0.5 $D_1$. $D_3$–$D_2$ is the same range as $D_1$–$D_4$. $D_4$–$D_3$ is typically less than or equal to $D_2$–$D_1$. The head height, $H_1$ is typically 0.1 $D_1$ to 2.0 $D_1$.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A shaped charge device comprising:

a liner;

a first explosive fill surrounding said liner;

a first confining case surrounding said first explosive fill;

a second explosive fill surrounding said first confining case;

a second confining case surrounding said second explosive fill;

means to initiate said first and second explosive fills;

said means to initiate comprising a detonator followed by a booster, said booster having a waveshaper contained therein, said waveshaper positioned within said booster such that said detonator first ignites a portion of said booster that is in contact with said second explosive fill and that is not in contact with said first explosive fill thereby causing said second explosive fill to ignite first and said first explosive fill to ignite second.

2. The device of claim 1 wherein said explosive fills and said confining cases are coaxial.

3. The device of claim 2 wherein said confining cases are made from a composite material.

4. The device of claim 2 wherein said liner is arcuate in shape.

5. The device of claim 2 wherein said confining cases are made from metal.

6. The device of claim 2 wherein said confining cases are made from ceramics.

* * * * *